US006755931B2

(12) United States Patent
Vollm et al.

(10) Patent No.: US 6,755,931 B2
(45) Date of Patent: Jun. 29, 2004

(54) APPARATUS AND METHOD FOR APPLYING LABELS TO A CONTAINER

(75) Inventors: James Vollm, Pittsburgh, PA (US); Manoj Wangu, Wexford, PA (US); Jeffery Hill, Upper St. Clair, PA (US)

(73) Assignee: McKesson Automation Systems Inc., Pittsburgh, PA (US)

( * ) Notice: Subject to any disclaimer, the term of this patent is extended or adjusted under 35 U.S.C. 154(b) by 0 days.

(21) Appl. No.: 10/197,742

(22) Filed: Jul. 18, 2002

(65) Prior Publication Data

US 2004/0011458 A1 Jan. 22, 2004

(51) Int. Cl.[7] ..... B65C 3/08

(52) U.S. Cl. ..... 156/277; 156/215; 156/DIG. 9; 156/DIG. 11; 156/DIG. 13

(58) Field of Search ..... 156/215, 277, 156/384, 387, 447, 475, 542, DIG. 8, DIG. 9, DIG. 10, DIG. 11, DIG. 12, DIG. 13, DIG. 25, DIG. 26, DIG. 27

(56) References Cited

U.S. PATENT DOCUMENTS

| | | | | |
|---|---|---|---|---|
| 3,058,514 A | * | 10/1962 | Flood | 156/542 |
| 3,601,261 A | | 8/1971 | Michot | |
| 4,397,710 A | * | 8/1983 | Gaylord | 156/475 |
| 5,224,586 A | * | 7/1993 | Naka et al. | 198/803.11 |
| 5,341,854 A | | 8/1994 | Zezulka et al. | |
| 5,421,948 A | | 6/1995 | Crankshaw et al. | |
| 5,449,078 A | | 9/1995 | Akers | |
| 5,570,920 A | | 11/1996 | Crisman et al. | |
| 5,628,847 A | | 5/1997 | Sowden | |
| 5,642,906 A | | 7/1997 | Foote et al. | |
| 5,645,669 A | | 7/1997 | Crankshaw et al. | |
| 5,798,020 A | | 8/1998 | Coughlin et al. | |

(List continued on next page.)

FOREIGN PATENT DOCUMENTS

| | | |
|---|---|---|
| DE | 26 21 985 A | 12/1977 |
| DE | 40 39 167 A | 6/1992 |

OTHER PUBLICATIONS

Sommer–automatic GmbH 2000 (catalog), 3–Jaw Gripper, pp. 45 and 46.

Sommer–automatic gmbh, www.sommer–automatic.com, Electric 3–Jaw Gripper, Type GED1302, GED1306, GED1502, GED1506, 4 sheets.

Sommer–automatic GmbH 2000 (catalog), 3–Jaw Gripper, Type GD1, GD10, GD50, GD29, 6 sheets.

Sommer–automatic (catalog) Gripper Overview, 1 sheet.

http://www.techno–sommer.com/DsgHint19.htm, Techno Sommer automatic, Design Problems In Automation: Finding a Gripper That Eliminates Pneumatic Air Lines without Sacrificing any Power, Speed or Options!, pp. 1–2.

Sommer–automatic GmbH 2000 (catalog), 3–Jaw Gripper sealed and rust–resistant, Type GD46, GD70, GD110, GD160, 6 sheets.

Sommer–automatic GmbH 2000 (catalog), 3–Jaw Gripper with T–slot Guide, Type GD304, GD306, GD308, GD310, GD312, GD316, GD320, GD380, 12 sheets.

*Primary Examiner*—Melvin C. Mayes
(74) *Attorney, Agent, or Firm*—Thorp Reed & Armstrong, LLP

(57) ABSTRACT

A chuck assembly comprises a housing defining a longitudinal axis and having a first end. A plurality of pins extend substantially parallel with the axis from the first end. The plurality of pins is located at a first radius relative to the axis. At least one of the pins is operable to move from the first radius to a second radius, relative to the axis. The chuck assembly also includes a means for moving at least one pin between the first radius and the second radius. A prime mover provides the necessary drive to the means for moving. The chuck assembly may be used in combination with various other components to form combinations or systems. A method of labeling a container is also disclosed.

7 Claims, 8 Drawing Sheets

U.S. PATENT DOCUMENTS 5,803,521 A 9/1998 Zejda et al.
5,855,395 A 1/1999 Foote et al.
5,873,488 A 2/1999 Guerra
6,036,231 A 3/2000 Foote et al.
6,036,812 A 3/2000 Williams et al.
6,115,996 A 9/2000 Yuyama et al.
6,240,394 B1 5/2001 Uecker et al.
6,308,494 B1 10/2001 Yuyama et al.

* cited by examiner

APPARATUS AND METHOD FOR APPLYING LABELS TO A CONTAINER

FIELD OF THE INVENTION

The present invention relates generally to the field of processing and packaging consumer products, particularly in the pharmaceutical industry. More specifically, the present invention relates to an apparatus and method for applying a label to a container, such as a vial for pharmaceuticals.

BACKGROUND

The use of automated labeling systems for packaging pharmaceutical products, such as pill vials, is known in the art. Examples of such systems include U.S. Pat. No. 6,308,494 B1 to Yuyama et al., U.S. Pat. No. 6,036,812 to Williams et al., and U.S. Pat. No. 5,798,020 to Coughlin et al. In a typical system, a vial is placed into a labeler and held in place by a gripping mechanism. As the vial is rotated, a label is applied to the vial and the vial is removed from the labeler.

Prior art labeling systems use various types of gripping mechanisms to secure the vial while a label is being applied. The prior art gripping mechanisms, however, do not easily adapt to handle vials having different diameters. For example, a system set up to place labels on vials with a small diameter cannot easily be converted to place labels on vials with a larger diameter. In typical prior art labeling systems, the labeling process must be halted and a different sized gripping mechanism substituted to accommodate a vials of different diameters. Furthermore, even if the gripping mechanism is capable of accommodating different sized vials, alignment problems (i.e., alignment of the label relative to the vial) are often encountered. Also, vials of different height cannot be labeled in the preferred method which is near the vial opening.

Thus, a need exists for a labeling system having a vial gripping mechanism that can accommodate different sized vials without requiring changes in hardware. Additionally, a need exists for a labeling system that enables labels to be accurately aligned in the preferred location on a vial, regardless of the vial's size.

SUMMARY

One embodiment of the present invention is directed to a chuck assembly comprising a housing defining a longitudinal axis and having a first end. A plurality of pins extend substantially parallel with the axis from the first end. The plurality of pins is located at a first radius relative to the axis with at least one of the pins being operable to move from the first radius to a second radius, relative to the axis. The pins move from the first radius to the second radius without exposing a cavity on or within the chuck assembly. A means for moving the at least one pin between the first radius and the second radius is also provided. The means for moving may comprise any known combination of gears, cams, and other mechanical components for imparting the desired motion to the pins.

The chuck assembly of the present invention may be used in combination with various other components. For example, the chuck assembly may be used in a container labeling system comprising a printer stand, a label printer, a vial drive assembly, a stand assembly, and the chuck assembly.

The present invention is also directed to a method for labeling a container comprising placing a container on a gripping mechanism having a plurality of movable gripping pins for inserting into the container. The gripping mechanism is activated to engage the container with the gripping pins. The container is brought into engagement with a source of labels and a label is applied to the container. The container is taken out of engagement with the source of labels and the gripping mechanism is deactivated to disengage the gripping pins from the container.

The present invention enables vials of various diameters to be handled by a single device without the need to change hardware. The present invention also enables labels to be uniformly placed on vials of different lengths. Those advantages and benefits, and others, will be apparent from the Detailed Description appearing below.

BRIEF DESCRIPTION OF THE DRAWINGS

To enable the present invention to be easily understood and readily practiced, the present invention will now be described, for purposes of illustration and not limitation, in connection with the following figures wherein.

DETAILED DESCRIPTION

Figure 1:
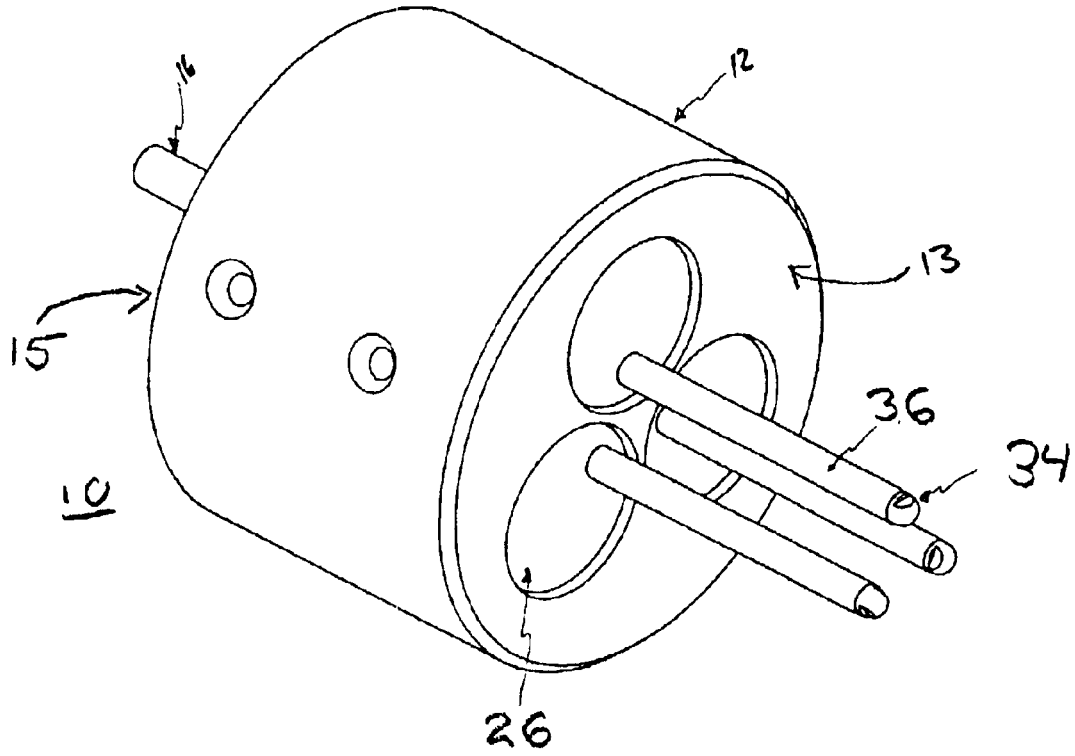
FIG. 1 is a perspective view of a chuck assembly for gripping containers of various diameters according to an embodiment of the present invention.

FIG. 1 is a perspective view of a chuck assembly 10 for gripping containers of various diameters according to an embodiment of the present invention. Chuck assembly 10 is a gripping mechanism that is used to secure and transport a container, for example, to and from a station where a label is applied. The chuck assembly 10 is comprised of a chuck body 12, which is a housing for the various parts of chuck assembly 10. Chuck assembly 10 has one or more chuck pins 34 extending from a first end 13 of the chuck body 12. The chuck pins 34 extend substantially parallel with a longitudinal axis of the chuck body 12, which may be a central axis. Each chuck pin 34 may have a roller sleeve 36 associated therewith. In the current embodiment, each chuck pin 34 is attached to a cam shaft 26 housed within the chuck body 12. Each cam shaft 26 may be rotated by a single drive shaft 16 which enters the chuck body 12 from a second end 15.

As illustrated in FIG. 1, each pin 34 may be rotated by its associated cam shaft 26 without exposing the interior housing of the chuck body 12 and without creating a cavity relative the chuck body 12, the cam shafts 26, and the chuck pins 34, among others. Thus, the chuck assembly of the present invention prevents contaminants from entering the chuck body or restricting the rotation of the cam shaft 26 and chuck pins 34.

Figure 2:
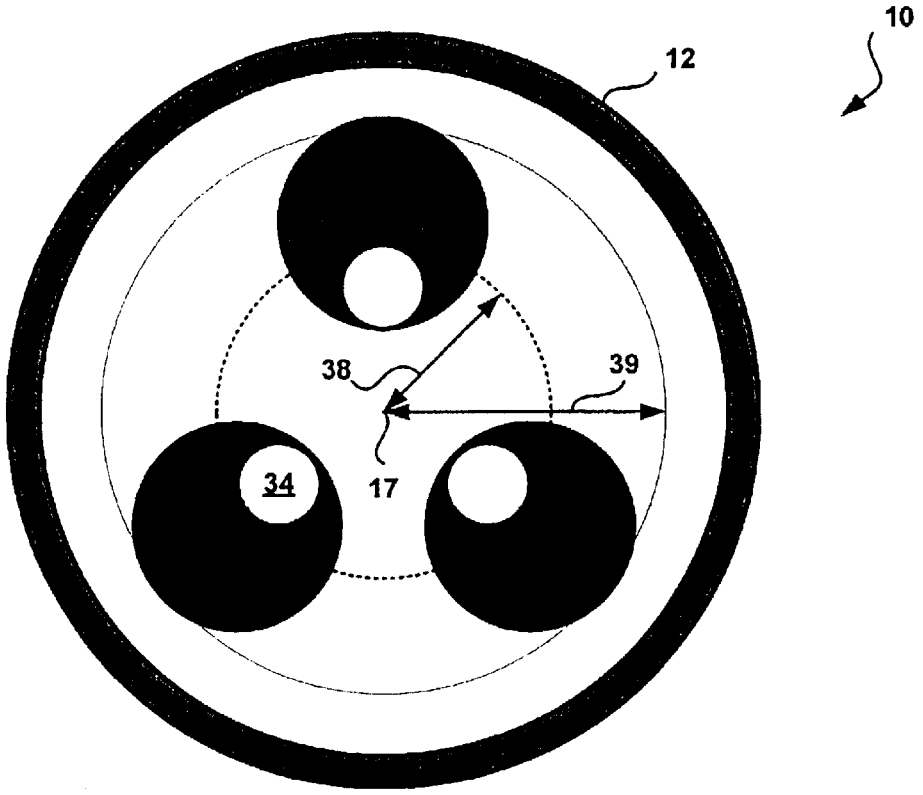
FIG. 2 is a front view of the chuck assembly of FIG. 1 with the chuck pins in a disengaged position according to an embodiment of the present invention.
Figure 3:
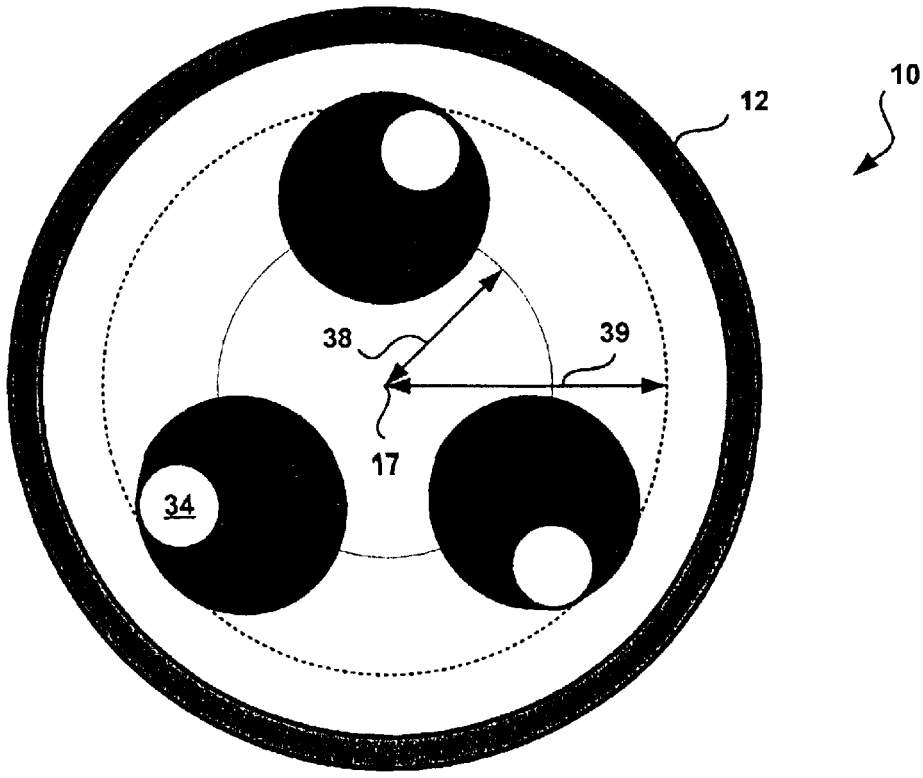
FIG. 3 is a front view of the chuck assembly of FIG. 1 with the chuck pins in an engaged position according to an embodiment of the present invention.

FIGS. 2 and 3 are front views of the chuck assembly 10 illustrated in FIG. 1. FIGS. 2 and 3 illustrate the chuck pins 34 in a disengaged position and in an engaged position, respectively, according to an embodiment of the present invention. The outer edges of chuck pins 34 are positioned at a first radius relative to a point 17 laying along the longitudinal axis of the chuck body 12. In the current embodiment, each chuck pin 34 is attached near an outer edge of its respective cam shaft 26, so that when cam shafts 26 are rotated, the radius measured from the chuck pins 34 to the point 17 is changed. In the disengaged position (as illustrated in FIG. 2), the outer edges of the chuck pins 34 are at a first radius 38. The disengaged position refers to a position in which the chuck pins 34 are not securing a container, such as a vial, that is placed over the chuck pins 34. In the engaged position (as illustrated in FIG. 3), the outer edges of the chuck pins 34 are at a second radius 39; the second radius 39 being larger than the first radius 38. The engaged position refers to a position in which the chuck pins 34 secure a container, such as a vial, that is placed over the chuck pins 34.

In the current embodiment, the chuck pins 34 begin in the disengaged position (i.e., positioned at the first radius 38). A vial (not shown) is loosely placed over the chuck pins 34 and pushed towards the chuck body 12 such that the vial comes in contact with the chuck body 12. Once the vial is in place, the drive shaft 16 is rotated, causing each cam shaft 26 to rotate in, for example, a counter-clockwise direction. The drive shaft 16 is rotated until the chuck pins 34 engage the vial (i.e., come into contact with the vial's inner walls). Thus, the second radius 39 (corresponding to the engaged position) is equal to the inner radius of the vial. In the current embodiment, the maximum angular rotation of the cam shafts 26 is limited to 120°.

The roller sleeves 36 permit an engaged vial to be rotated by a vial drive motor (not shown in FIGS. 2 and 3) while the vial is engaged by the chuck pins 34 (for example, while a label is being placed on the vial). After a label is placed on the vial, the drive shaft 16 is rotated in the opposite direction causing the cam shaft 26 to rotate in the clockwise direction. The rotating cam shafts 26, in turn, cause the chuck pins 34 to disengage the vial (i.e., to travel from the second radius 39 to the first radius 38). The labeled vial is then removed from the chuck pins 34.

It should be noted that the rotational direction used to engage and disengage a vial may be reversed (i.e., clockwise to engage, counter-clockwise to disengage) and/or mixed (i.e., one cam shaft 26 rotating clockwise with another cam shaft 26 rotating counter-clockwise) while remaining within the scope of the present invention. It should further be noted that the present invention is not intended to limit the chuck pins 34 to a rotational manner of travel. For example in an alternative embodiment, the chuck pins 34 may move radially relative to the point 17, from the first radius 38 to the second radius 39. In the alternative embodiment, other components may replace or accompany the drive shaft 16 and cam shafts 26 to effect the linear motion. Furthermore, a shield to eliminate the exposure of a cavity on or within the chuck body (and thus, preventing contaminants from entering the chuck body), may be associated with each pin 34.

Figure 4:
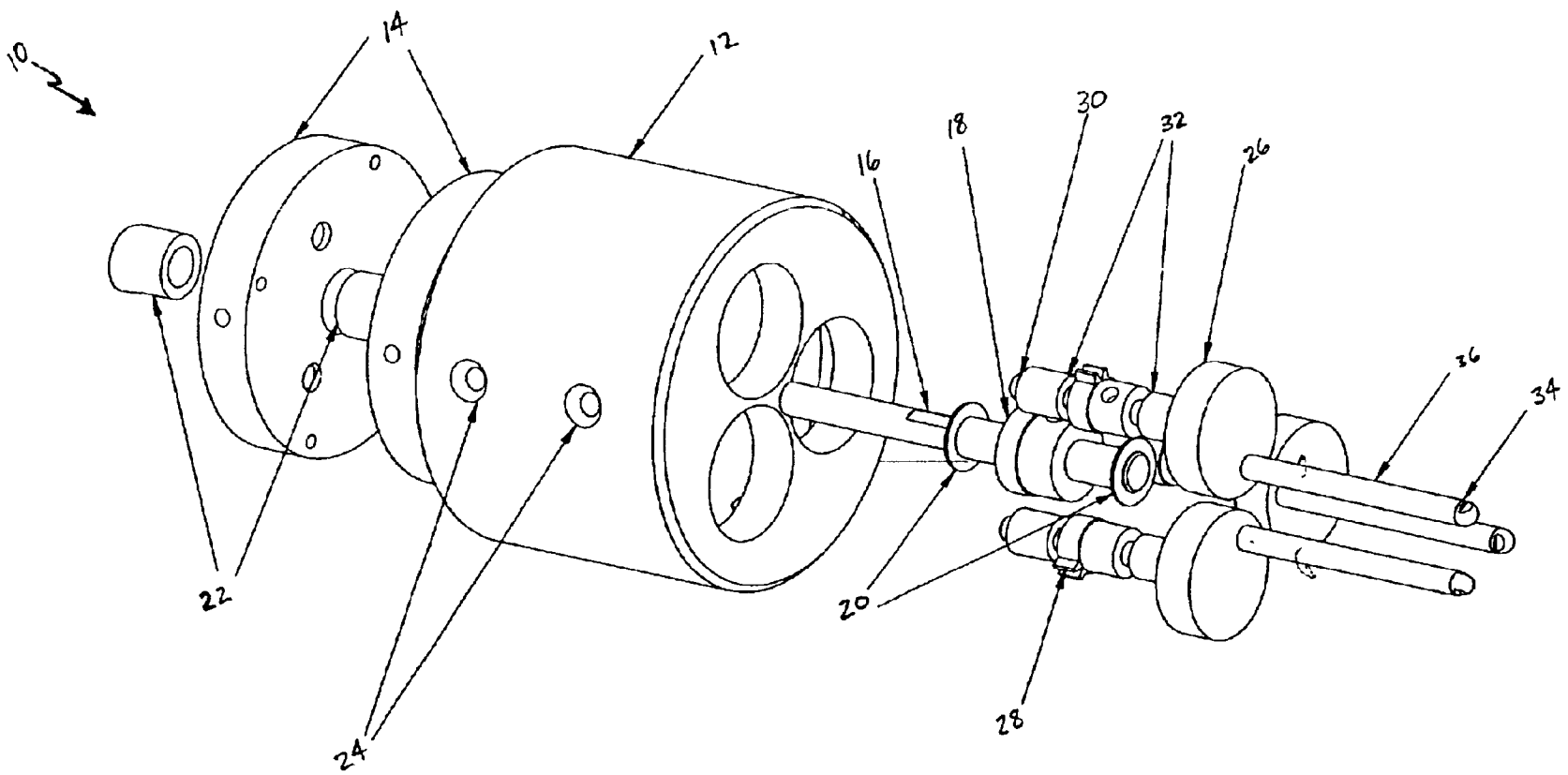
FIG. 4 is a detailed view of the internal components of the chuck assembly of FIG. 1 according to an embodiment of the present invention.

FIG. 4 is a detailed view of the internal components of the chuck assembly 10 of FIG. 1 according to one embodiment of the present invention. As illustrated in FIG. 4, each chuck pin 34 is attached to one end of its respective cam shaft 26. A cam shaft spur gear 28 is carried between a pair of cam shaft needle bearings 32, all of which are secured to the cam shaft 26 by a cam shaft retaining ring 30. In the current embodiment, three chuck pins 34 are used, however, it should be noted that a different number of chuck pins 34 may be used while remaining within the scope of the present invention.

The cam shaft spur gears 28 mesh with a drive shaft spur gear 18 carried between and secured to the drive shaft 16 by a pair of drive shaft retaining rings 20. In the current embodiment, a single drive shaft spur gear 18 is used to mesh with each cam shaft spur gear 28. It should be noted multiple drive shaft spur gears 18 or multiple drive shafts 16 may be used to rotate the cam shafts 26 while remaining within the scope of the present invention.

In the current embodiment, the drive shaft 16, drive shaft spur gear 18, cam shafts 26, and cam shaft spur gears 28 are a means for moving the chuck pins 34 between the first radius and the second radius. It should be noted that alternative means for moving said chuck pins 34 may be used while remaining within the scope of the present invention. For example, a means using one or more pins, linkages, crank arms, jacks, radius bars, screw gears, winches, yokes, connecting rods, levers, toggles, cables, belts, bell cranks, clutches, pulleys, couplings and/or sprockets (among others) may be used while remaining within the scope of the present invention.

The drive shaft 16, drive shaft spur gear 18, drive shaft retaining rings 20, cam shafts 26, cam shaft spur gears 28, cam shaft retaining rings 30, and cam shaft needle bearings 32, among others, are contained with the chuck body 12. In the current embodiment, the first end 13 of the chuck body 12 has an opening for each chuck pin 34. The chuck pins 34 extend parallel with a longitudinal axis of the chuck body 12. The second end 15 of the chuck body 12 is located opposite the first end 13. An alternating pair of bearing plates 14 and drive shaft needle bearings 22 are attached to the chuck body 12 at the second end 15. The bearing plates restrain the drive shaft and cam shaft components within the chuck body 12, whereas the drive shaft needle bearings 22 allow the drive shaft 16 to freely rotate while passing through bearing plates 14. A prime mover (such as a rotary solenoid, electric motor, pneumatic piston, hydraulic piston, among others)(not shown in FIG. 4) is a device that is coupled to and imparts the necessary force to the means for moving the chuck pins 34.

In the current embodiment, a rotary solenoid 46 is used as the prime mover to impart a rotational force on the drive shaft 16. One of the advantages of using a rotary solenoid is the limited torque produced by the rotary solenoid. For example, the rotary solenoid may be selected so as to provide a known torque for rotating shaft 16, and thus rotating cam shafts 26 from a minimum radius to a maximum radius. If a vial having a radius somewhere between the minimum and maximum is placed on the chuck assembly 10, sufficient torque will be generated to rotate cam shafts 26 to bring chuck pins 34 into engagement with the inner wall of the vial. However, resistance caused by contact between the chuck pins 34 and the inner wall of the vial will be sufficient to cease movement of the cam shafts 26 and drive shaft 16 without damaging the rotary solenoid. Furthermore, the rotary solenoid does not provide sufficient torque to damage the vial.

Figure 5:
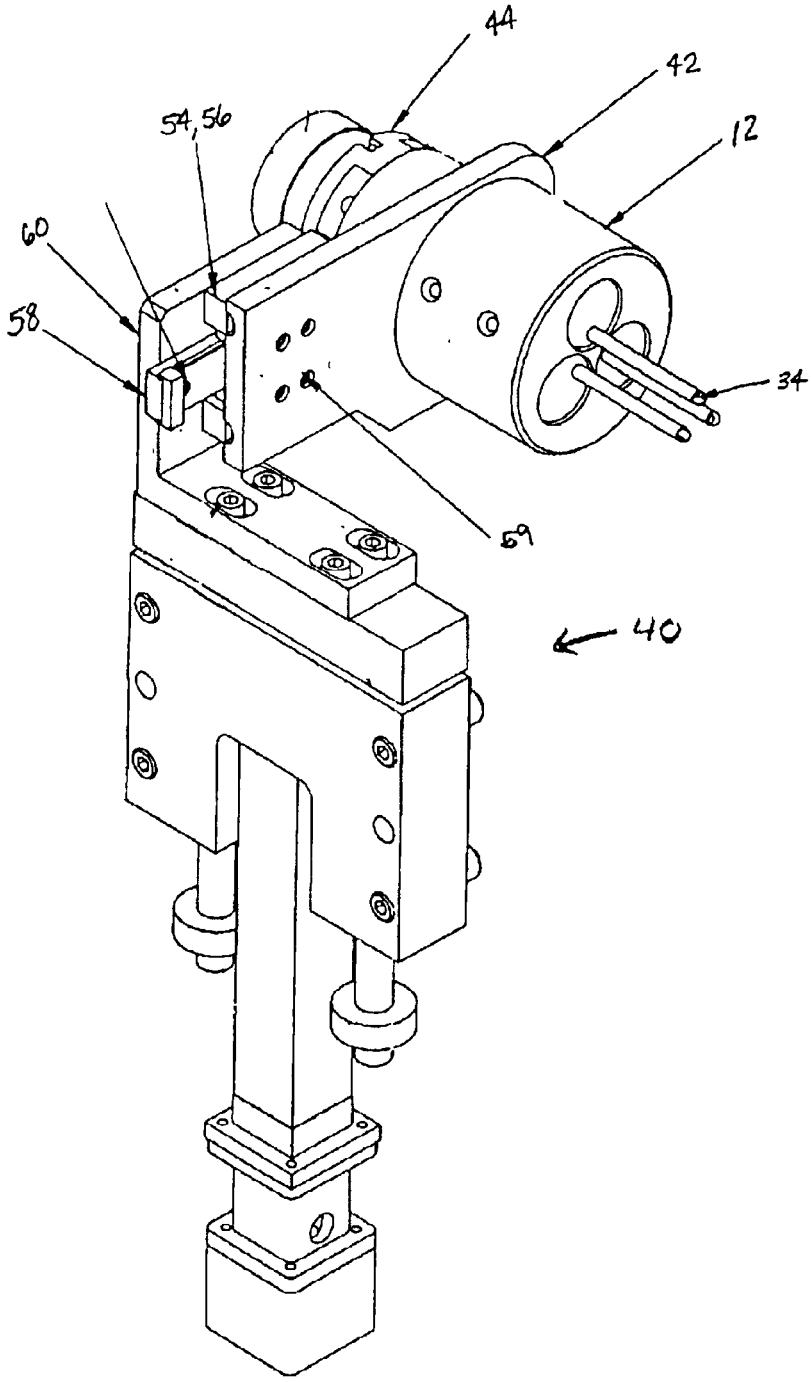
FIG. 5 is a front view of a chuck stand assembly for mounting the chuck assembly of FIG. 1 according to an embodiment of the present invention.
Figure 6:
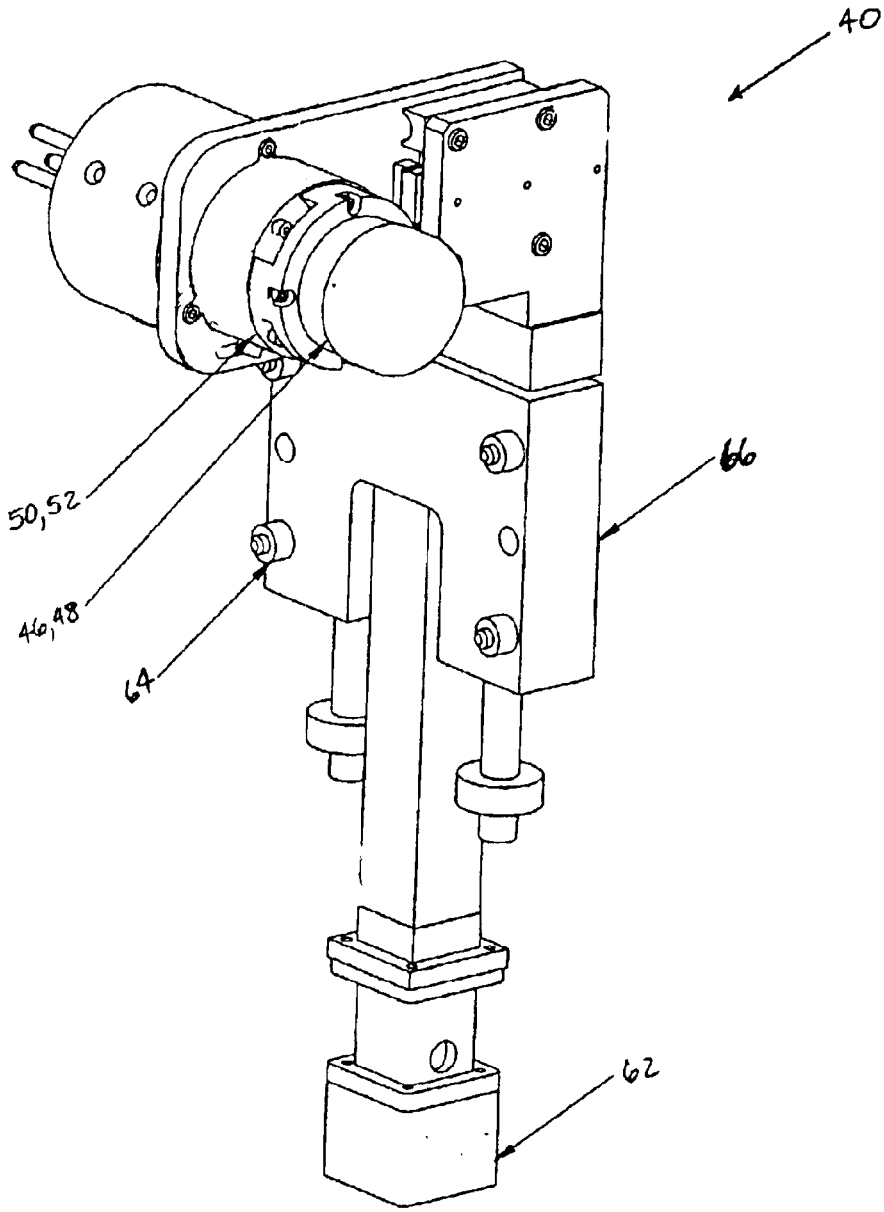
FIG. 6 is a rear view of the chuck stand assembly of FIG. 5 according to an embodiment of the present invention.

FIGS. 5 and 6 are a front view and a back view, respectively, of a chuck stand assembly 40 for mounting the chuck assembly 10 of FIG. 1 according to an embodiment of the present invention. Chuck stand assembly 40 includes a chuck assembly mounting plate 42 for mounting the chuck assembly 10. The chuck assembly mounting plate 42 is also used to mount and align a hub brake 50, brake release 52, rotary solenoid 46, and flexible coupling 48 with the chuck assembly 10. The chuck assembly mounting plate 42 is coupled to a slide mount bracket 60 with screws 59. A linear bearing 58, attached to a slide mount bracket 60 and having a compression spring 56 housed within a spring pocket 54, permits the horizontal position of the chuck assembly mounting plate 42 to be adjusted.

Figure 8:
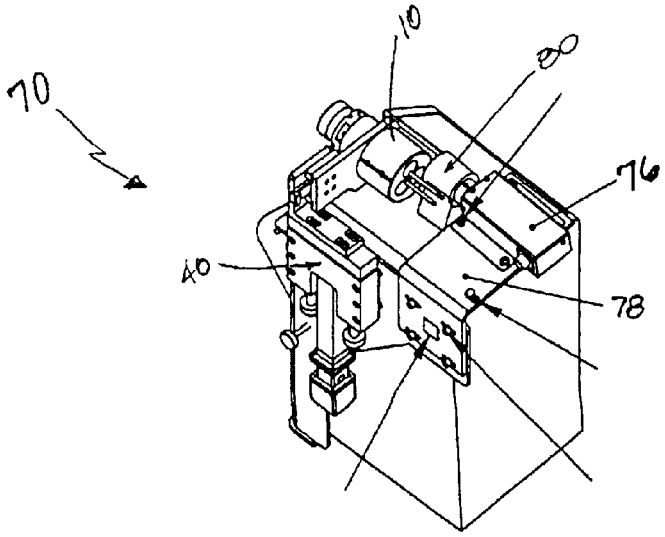
FIG. 8 is a top view of the labeling system of FIG. 7 according to an embodiment of the present invention.

In the current embodiment, a preferred horizontal position is set such that the smallest diameter vial to be labeled will be pressed against the vial drive assembly 76 (as discussed in more detail in conjunction with FIG. 8). By setting the chuck assembly mounting plate 42 in this position, the labeler system 70 can accommodate larger vials without changing hardware. Specifically, when a larger vial (secured by the chuck assembly 10) is placed against the vial drive assembly 76, the compression spring 56 permits the chuck assembly mounting plate 42 to move horizontally to accommodate the larger vial. It should be noted that other horizontal adjustment means for the chuck assembly mounting plate 42 may be used while remaining within the scope of the present invention. For example, an actuator may be used for adjusting the position of the chuck assembly mounting plate 42.

The slide mount bracket 60 is attached to an actuator 66, which is driven by a stepper motor 62. The actuator 66 permits the vertical position of the combination of the slide mount bracket 60 and chuck assembly 10 to be adjusted. In the current embodiment, a linear ball screw actuator 66 is used. It should be noted that other types of actuators and motors may be used while remaining within the scope of the present invention. It should further be noted that chuck stand assembly 40 of the present invention is not intended to be limited to the chuck assembly 10 described above. Other types of electric chuck assemblies such as those manufactured by Sommer Automatic (e.g., Electric 3-Jaw Grippers catalog numbers GED1302, GED1306, GED1502, and GED1506) and Robohand (e.g., RPZ Electric Gripper), among others, may be used with the chuck stand assembly 40 while remaining within the scope of the present invention.

Figure 7:
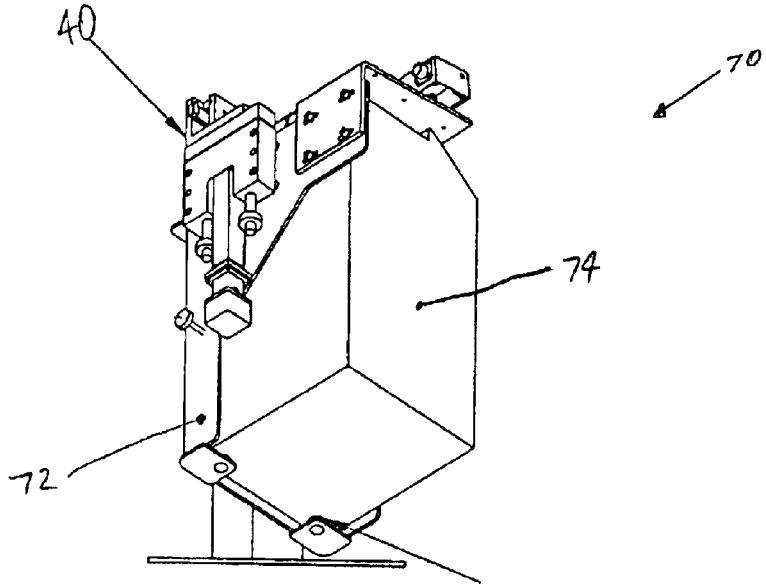
FIG. 7 is a perspective view of a labeling system incorporating the chuck stand assembly of FIG. 5 according to an embodiment of the present invention.

FIGS. 7 and 8 illustrate a labeling system 70 incorporating the chuck stand assembly of FIG. 5 according to an embodiment of the present invention. FIG. 7 is a perspective view, and FIG. 8 is a top view of the labeling system 70.

Labeling system 70 includes a printer stand 72, label printer 74, chuck stand assembly 40 (with chuck assembly 10), a vial drive assembly 76, and vial drive mount bracket 78. The printer stand 72 supports label printer 74, chuck stand assembly 40, and vial drive mount bracket 78. Vial drive assembly 76 includes a vial drive motor (not shown) and a vial drum (not shown). In the current embodiment, a roll of labels is fitted over the vial drum, the labels are placed in contact with a vial and the vial drive motor rotates the labels, and thus, the vial.

As best illustrated in FIG. 8, the labeling system 70 is configured such that a vial (not shown), which is secured by the chuck assembly 10, is aligned with and comes into contact with a printed label 80. In the current embodiment, the labeling system 70 operates in the following manner. The actuator 66 is raised by the stepper motor 62 such that the chuck assembly 10 moves away from the vial drive assembly 76 to a vial exchange position. The chuck pins 34 are reset to the disengaged position. A vial is then placed over the chuck pins 34. For example, a robot arm from a prescription filling station may be used to place the vial over the chuck pins 34. One example of a prescription filling station with which the labeling system 70 may be used is shown in U.S. Pat. No. 6,006,946, which is hereby incorporated by reference. The brake release 52 is activated to release hub brake 50, thus allowing the drive shaft 16 to rotate. The rotary solenoid 46 is then activated to move the chuck pins 34 to the engaged position. Once the chuck pins 34 reach the engaged position, the rotary solenoid 46 begins to "torque out" and the hub release 52 is deactivated. When the hub release 52 is deactivated, the hub brake 50 prevents the drive shaft 16 from rotating, and thus locks the chuck pins 34 in the engaged position. Once the hub brake 50 locks the drive shaft 16 in position, the rotary solenoid 46 is deactivated.

The actuator 66 of the chuck stand assembly 40 is then lowered by the stepper motor 62 until the vial comes into contact with the vial drive assembly 76. The compression spring 76 permits the chuck assembly mounting plate to slightly move in the horizontal direction as required to help facilitate vials of different radii. Printer 74 prints the desired information onto a label 80. The vial drive assembly 76 simultaneously rotates and applies the printed label to the vial. After the printed label is applied to the vial, the actuator 66 is raised by the stepper motor 62 until the chuck assembly 10 reaches the vial exchange position. The brake release 52 is then activated and the hub brake 50 releases the drive shaft 16. The chuck pins 34 are then returned to the disengaged position. The vial is removed from the chuck pins 34 (for example, using the prescription filling station's robot arm). The next vial to be labeled may then be placed over the chuck pins 34.

It should be noted that the operation of the brake release 52 and hub brake 50 may be altered while remaining within the scope of the present invention. For example, the brake release 52 may be activated to engage the hub brake 50 and deactivated to release the hub brake 50. Additionally, the hub brake 50 may prevent the movement of another means for moving (for example, a cam shaft 26) the chuck pins 34 while remaining within the scope of the present invention. Furthermore, the brake release 52 and hub brake 50 may be combined into a single unit.

As discussed above in conjunction with FIGS. 5 and 6, other types of electric chuck assemblies such as those manufactured by Sommer Automatic (e.g., Electric 3-Jaw Grippers catalog numbers GED1302, GED1306, GED1502, and GED1506) and Robohand (e.g., RPZ Electric Gripper), among others, may be used with the chuck stand assembly 40 while remaining within the scope of the present invention.

Figure 9:
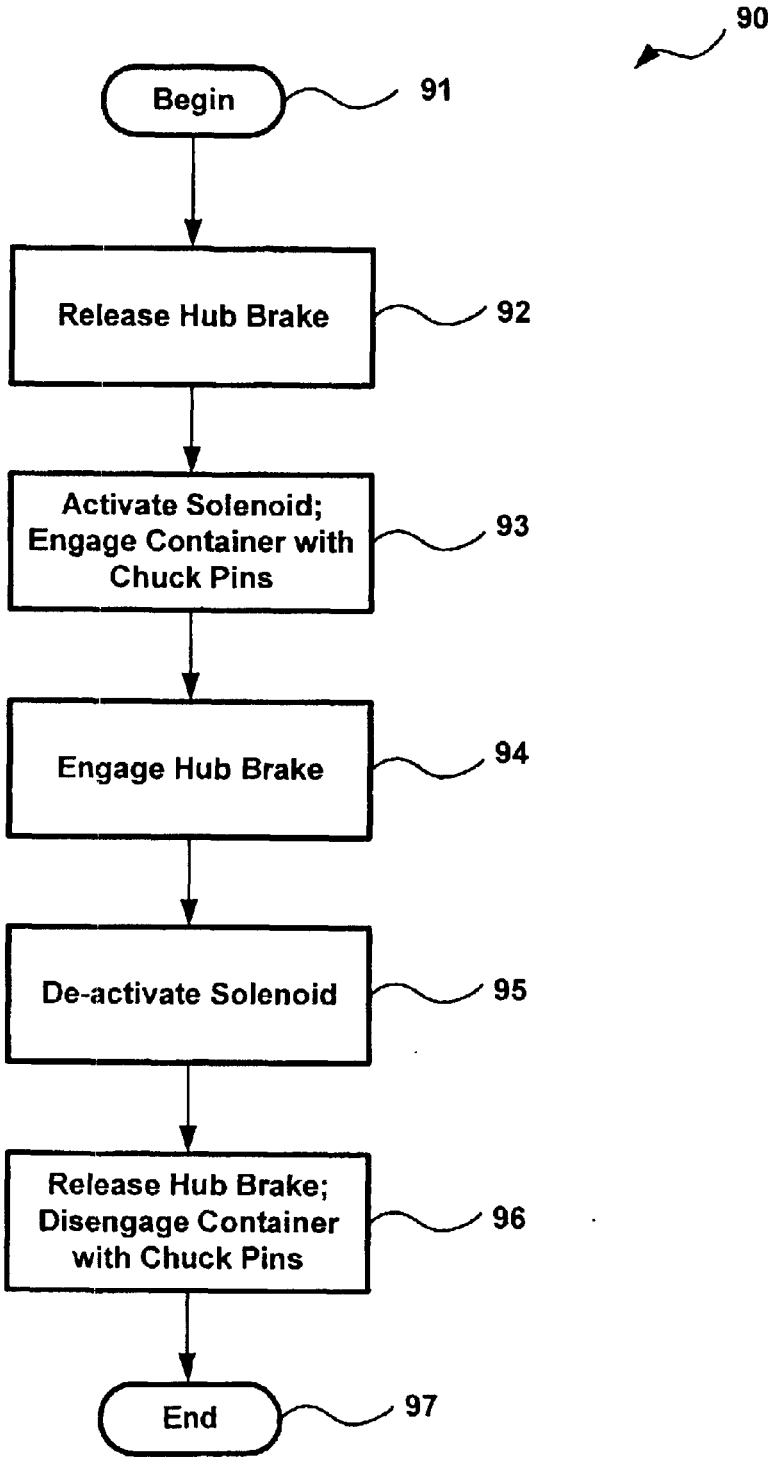
FIG. 9 is an operational process for gripping a container according to an embodiment of the present invention.

FIG. 9 is an operational process 90 for gripping a container according to an embodiment of the present invention.

Operation 91 initiates operational process 90 when a container is placed over the chuck pins 34 of the chuck assembly 10. In the current embodiment, the container is a vial. The vial is pushed over the chuck pins 34 (which are in the disengaged position) until the vial comes into contact with the chuck body 12.

Operation 92 assumes control after operation 91 initiates operational process 90. In operation 92, the hub brake 50 is released, thus allowing drive shaft 16 to rotate. In the current embodiment, hub brake 50 is released when brake release 52 is activated. After the hub brake 50 is released, operation 93 assumes control.

In operation 93, the rotary solenoid 46 is activated causing the chuck pins 34 to engage the interior surface of the vial. In the current embodiment, the rotary solenoid rotates drive shaft 16 having drive shaft spur gear 18 that is meshed with one or more cam shaft spur gears 28. Each of the cam shaft spur gears 28 causes its respective cam shaft 26 to rotate, which in turn causes its associated chuck pin 34 attached at the end of the cam shaft 26 to move from the first radius 38 to the second radius 39 relative to the point 17. After the rotary solenoid is activated by operation 93, operation 94 assumes control.

Operation 94 engages the hub brake 50 when the rotary solenoid 46 begins to "torque out". In the current embodiment, the rotary solenoid begins to torque out when the chuck pins 34 come into contact with the inner walls of the vial. The hub release 52 is deactivated causing the hub brake 50 to engage the drive shaft 16. When engaged, the hub brake 50 prevents the drive shaft 16 from rotating. After operation 94 engages the hub brake, operation 95 assumes control.

Operation 95 deactivates the rotary solenoid 46. When the rotary solenoid is deactivated, the chuck pins 34 remain in the engaged position because the drive shaft 16 is locked in place by the hub brake 50. The vial remains engaged until the hub brake 50 is released. The vial is now ready to be transported. Transportation in this case means to bring the vial into engagement with a source of labels. In other contexts, the vial might be transported to other types of workstations, e.g., a capping station. After the vial has been labeled, i.e., the work station has performed its function, the vial is transported back to the vial exchange position. In the embodiment shown, transporting the vial is accomplished by the stepper motor 62, although other means of transport may be provided.

After the vial returns to the vial exchange position, operation 96 releases the hub brake 50 and allows the chuck pins 34 to return to the disengaged position. In the current embodiment, the brake release 52 is activated to release the hub brake 50 and the chuck pins 34 automatically disengage the vial (for example, through the use of springs, the built-in tensioning of the cam shafts, etc.).

Operation 97 terminates operational process 90. After the vial is disengaged by operation 96, the vial may be removed and operational process 90 repeated with another vial.

Figure 10:
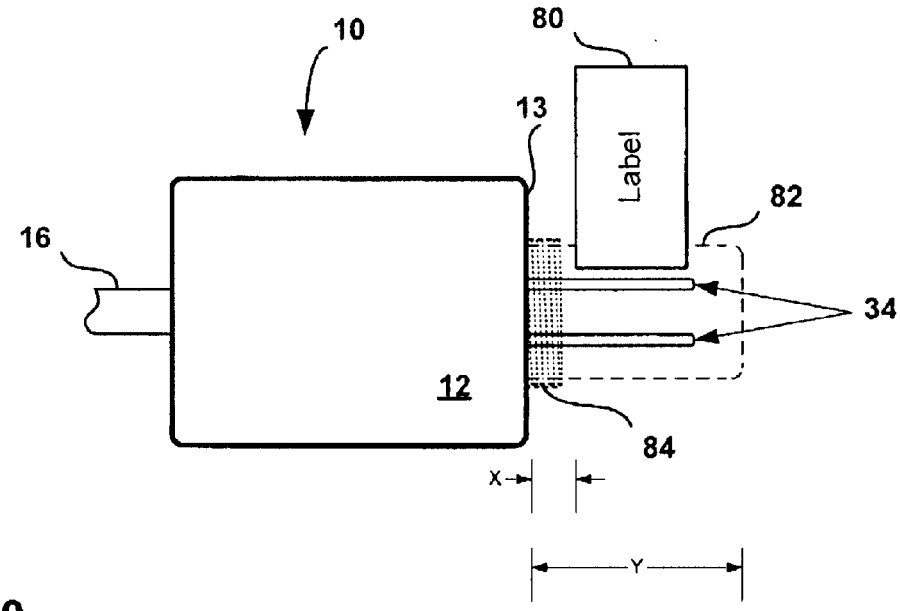
FIG. 10 illustrates the alignment of a label relative to a vial having a first length secured by the chuck assembly of FIG. 1 according to an embodiment of the present invention.
Figure 11:
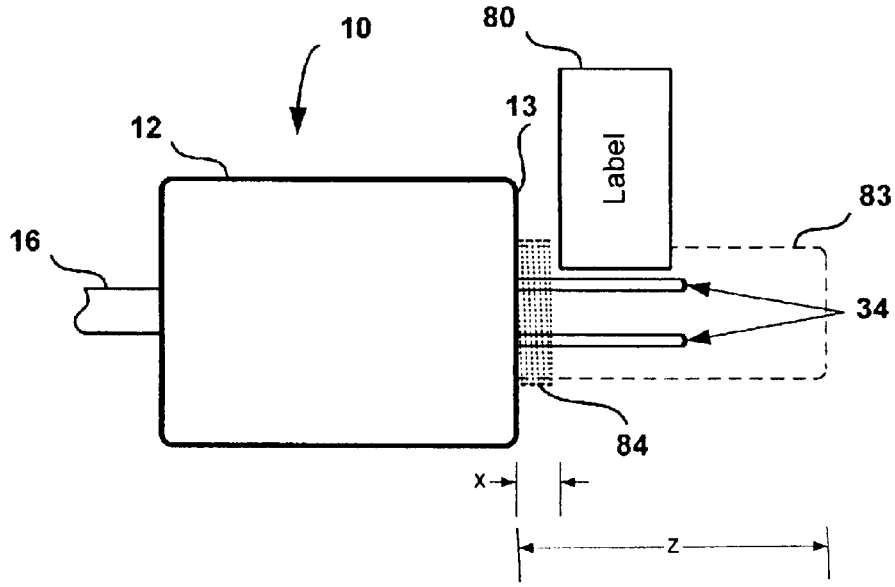
FIG. 11 illustrates the alignment of a label relative to a vial having a second length secured by the chuck assembly of FIG. 1 according to an embodiment of the present invention.

FIGS. 10 and 11 illustrates the alignment of a label 80 relative to vials 82, 83, respectively, secured by the chuck assembly 10 of FIG. 1 according to an embodiment of the present invention. In FIG. 10, vial 82 has a length "Y." In FIG. 11, vial 83 has a length "Z," where length Z is greater than length Y. Vials 82, 83 each have a set of threads 84 for securing a cap (not shown) to the vials. As illustrated in FIGS. 10 and 11, the distance (denoted "X") from the first end 13 of chuck body 12 to an upper edge of label 80 is constant. Thus as long as the threaded ends of vials 82, 83 are touching the first end 13 of chuck assembly 12 when the chuck pins 34 secure the vial, the alignment of the label 80 will be constant regardless of the length of the vial 82, 83.

The above-described embodiments of the invention are intended to be illustrative only. Numerous alternative embodiments may be devised by those skilled in the art without departing from the scope of the following claims. For example in an alternative embodiment, a gripping mechanism employing one or more stationary chuck pins 34 in combination with at least one movable chuck pin 34 is used.

What is claimed is:

1. A method for labeling a container, comprising:

placing a container on a gripping mechanism, said gripping mechanism having a plurality of movable gripping pins each with a movable contact surface for inserting into said container;

activating said gripping mechanism to engage said container with said gripping pins;

rotating said container relative to said gripping mechanism;

applying a label to said container; and de-activating said gripping mechanism to disengage said gripping pins from said container.

2. The method of claim 1 further comprising removing said container from said gripping mechanism.

3. The method of claim 1 wherein said applying a label to said container further comprises:

printing information on said label;

aligning said label and said container; and placing said label on said container.

4. The method of claim 1 wherein said placing a container on a gripping mechanism further comprises placing a container having an opening defined by inner walls over said plurality of gripping pins, said opening having a radius greater than a first radius of an outer surface of each of said plurality of gripping pins relative to a longitudinal axis of said gripping mechanism, wherein said outer surface of each of said plurality of gripping pins includes said movable contact surface.

5. The method of claim 4 wherein said activating said gripping mechanism further comprises moving at least one of said gripping pins radially outward from said longitudinal axis to a second radius, said second radius being substantially equal to the radius of said container opening.

6. The method of claim 5 wherein said de-activating said gripping mechanism further comprises moving said at least one of said gripping pins radially to said first radius.

7. The method of claim 1 wherein said movable contact surface includes a roller sleeve.

* * * * *

UNITED STATES PATENT AND TRADEMARK OFFICE

CERTIFICATE OF CORRECTION

PATENT NO. : 6,755,931 B2
DATED : June 29, 2004
INVENTOR(S) : Vollm et al.

It is certified that error appears in the above-identified patent and that said Letters Patent is hereby corrected as shown below:

Title page,
Item [75], Inventors, please delete "Jeffery Hill" and insert therefore -- Jeffrey Hill --.

Signed and Sealed this

Twenty-first Day of December, 2004

JON W. DUDAS
*Director of the United States Patent and Trademark Office*